US006821557B2

(12) United States Patent
Lee et al.

(10) Patent No.: US 6,821,557 B2
(45) Date of Patent: Nov. 23, 2004

(54) TUNGSTEN FILM COATING METHOD USING TUNGSTEN OXIDE POWDERS

(75) Inventors: Seong Lee, Daejeon (KR); Moon-Hee Hong, Seoul (KR); Joon-Woong Noh, Daejeon (KR); Eun-Pyo Kim, Daejeon (KR); Yoon-Sik Park, Chungcheongbuk-do (KR)

(73) Assignee: Agency for Defense Development, Daejeon (KR)

( * ) Notice: Subject to any disclaimer, the term of this patent is extended or adjusted under 35 U.S.C. 154(b) by 0 days.

(21) Appl. No.: 10/340,505

(22) Filed: Jan. 10, 2003

(65) Prior Publication Data

US 2003/0211238 A1 Nov. 13, 2003

(30) Foreign Application Priority Data

May 6, 2002 (KR) ..... 10-2002-0024857

(51) Int. Cl.[7] ..... B05D 1/12; B05D 3/04

(52) U.S. Cl. ..... 427/191; 427/180; 427/376.6; 427/376.8; 427/377

(58) Field of Search ..... 427/660, 665, 427/668, 686, 190, 180, 376.2–376.6; 502/305, 313–316, 318

(56) References Cited

U.S. PATENT DOCUMENTS 4,097,351 A * 6/1978 Caley et al. ..... 204/491
5,125,964 A * 6/1992 Buerkel et al. ..... 75/366

* cited by examiner

*Primary Examiner*—Fred J. Parker
(74) *Attorney, Agent, or Firm*—Scully, Scott Murphy & Presser

(57) ABSTRACT

Disclosed is a tungsten film coating method using tungsten oxide powders including the steps of contacting the tungsten oxide powders with a metal substrate and carrying out thermal reduction treatment thereon at a temperature of at least 650° C. under a hydrogen atmosphere just to coat the tungsten film on the metal substrate. Accordingly, the present invention enables to provide a simple method of coating a tungsten thin film on a metal substrate using the phenomenon of tungsten migration through vapor phase when thermal reduction treatment is carried out on tungsten oxide powders without using previous chemical or physical vapor depositions requiring expensive precision equipments or causing environmental pollution.

3 Claims, 7 Drawing Sheets

TUNGSTEN FILM COATING METHOD USING TUNGSTEN OXIDE POWDERS

BACKGROUND OF THE INVENTION

1. Field of the Invention

The present invention relates to a tungsten film coating method using tungsten oxide ($WO_3$ or $WO_{2.9}$) powders, and more particularly, to a method of coating a tungsten thin film a few nanometers (nm) to tens of micrometers ($\mu$m) thick on a metal substrate using a chemical vapor transport (CVT) reaction preferring to occur on the metal substrate. In this case, the CVT reaction occurs in a following manner. First of all, when the tungsten oxide powders are reduced to pure tungsten under a hydrogen atmosphere, solid phase of the tungsten oxide powders is changed into vapor phase, experiences diffusion so as to move to the metal substrate, and then changed into the solid phase again so as to be deposited thereon.

2. Background of the Related Art

As a method of coating a tungsten thin film on a metal substrate, chemical vapor deposition (CVD) by decomposing of $WF_6$ gas or physical vapor deposition (PVD) by sputtering of pure tungsten target is widely used so far. However, the CVD process is disadvantageous in that $WF_6$ as a reactant is toxic as well as HF is formed as a product so as to bring about environmental pollution. Besides, the PVD process requires the expensive tungsten target material as well as a high-vacuumed equipment of precision.

The present inventors have made many efforts to overcome the above-mentioned disadvantages or problems, and have developed a method of coating a tungsten on various metal substrates using a simple reduction treatment technique under a hydrogen atmosphere while the metal substrate is kept being contacted with tungsten oxide powders. Different from the method according to the related art, the method according to the present invention generates water as a product instead of toxic gas and enables to coat tungsten using a furnace operation under a reduction atmosphere without the expensive equipments.

SUMMARY OF THE INVENTION

Accordingly, the present invention is directed to a tungsten film coating method using tungsten oxide powders that substantially obviates one or more problems due to limitations and disadvantages of the related art.

An object of the present invention is to provide a method of coating a tungsten thin film on a metal substrate using the phenomenon of tungsten migration through vapor phase when thermal reduction treatment is carried out on tungsten oxide powders without using previous chemical or physical deposition requiring expensive precision equipments or causing environmental pollution.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a tungsten film coating method using tungsten oxide powders according to the present invention includes the steps of contacting the tungsten oxide powders with a metal substrate and carrying out thermal reduction treatment thereon at a temperature of at least 650° C. under a hydrogen atmosphere just to coat the tungsten film on the metal substrate.

Preferably, the metal substrate is selected from the group consisting of Cu, Fe, Ni, Co, Cr, and W substrates.

Preferably, the tungsten film is coated 500 nm~25 $\mu$m thick by carrying out thermal reduction treatment for 10 minutes to six hours at a temperature range between 650~1050° C.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE INVENTION

Reference will now be made in detail to the preferred embodiments of the present invention, examples of which are illustrated in the accompanying drawings.

A method of coating a tungsten thin film according to the present invention is carried out by the following manner.

First of all, tungsten oxide ($WO_3$ or $WO_{2.9}$) powders having a grains size of 1–10 $\mu$m are put on a metal substrate such as Cu, Ni, Fe, Co, Cr, W, or the like. When thermal reduction treatment is carried out thereon at 650° C. (temperature from which the metal substrate is coated with tungsten by reduction of the tungsten oxide powders) under a hydrogen atmosphere, the hydrogen gas reacts with oxygen contained in the tungsten oxide powders. Hence, steam is formed as well as composition of tungsten oxide is changed into $WO_2$. Such $WO_2$ powders react with adjacent moisture, as shown in the following chemical equation 1, so as to turn into tungsten oxide of $WO_2(OH)_2$ as a gas phase and hydrogen. The generated gaseous phase tungsten oxide $\{WO_2(OH)_2\}$ moves to the neighboring metal substrate by diffusion, and then reacts with adjacent hydrogen again, as shown in the following chemical equation 2, so as to be reduced to solid phase tungsten. In this case, if the metal substrate is around, the reaction by the chemical equation 2 occurs on the metal substrate preferentially (heterogeneous nucleation and growth) so as to coat the metal substrate with a tungsten thin film a few nanometers (nm) to tens of micrometers ($\mu$m) thick.

$$WO_2(S)+2H_2O(g)\ WO_2(OH)_2(g)+H_2(g) \quad \text{[Chemical Equation 1]}$$

$$WO_2(OH)_2(g)+3H_2(g)\ W(S)+4H_2O(g) \quad \text{[Chemical Equation 2]}$$

Figure 1:
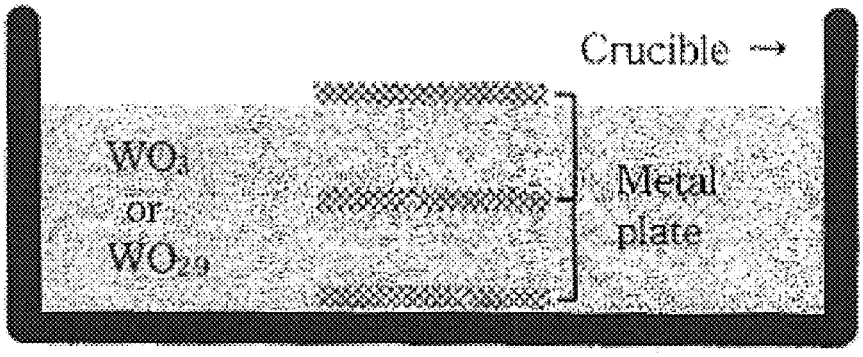
FIG. 1 illustrates a cross-sectional view of coating a tungsten thin film on a metal substrate according to the present invention.

FIG. 1 illustrates a cross-sectional view of coating a tungsten thin film on a metal substrate according to the present invention.

Referring to FIG. 1, after a Cu substrate is contacted with tungsten oxide powders, thermal reduction treatment is carried out under hydrogen atmosphere. Namely, the present invention includes the steps of putting a substrate of Cu, Ni, Fe, Co, Cr, W, or the like in an upper, middle, or lower portion of a tungsten oxide ($WO_3$ or $WO_{2.9}$) layer and carrying out thermal treatment thereon under a hydrogen atmosphere.

Such a coating method is widely applicable to another species of the metal substrate such as Ni, Fe, Co, Cr, W, and the like as well as Cu. Therefore, the tungsten oxide thin film method according to the present invention is applicable to any kind of metal substrates.

A tungsten thin film according to the present invention can be coated 500 nm~25 $\mu$m thick by carrying out thermal treatment for 10 minutes to six hours at a temperature range between 650~1050° C.

Hereinafter, a tungsten thin film coating method according to the present invention is explained by referring to the attached drawings for the embodiments of the present invention, which are merely exemplary and are not to be construed as limiting the present invention.

[First Embodiment]

Figure 2:
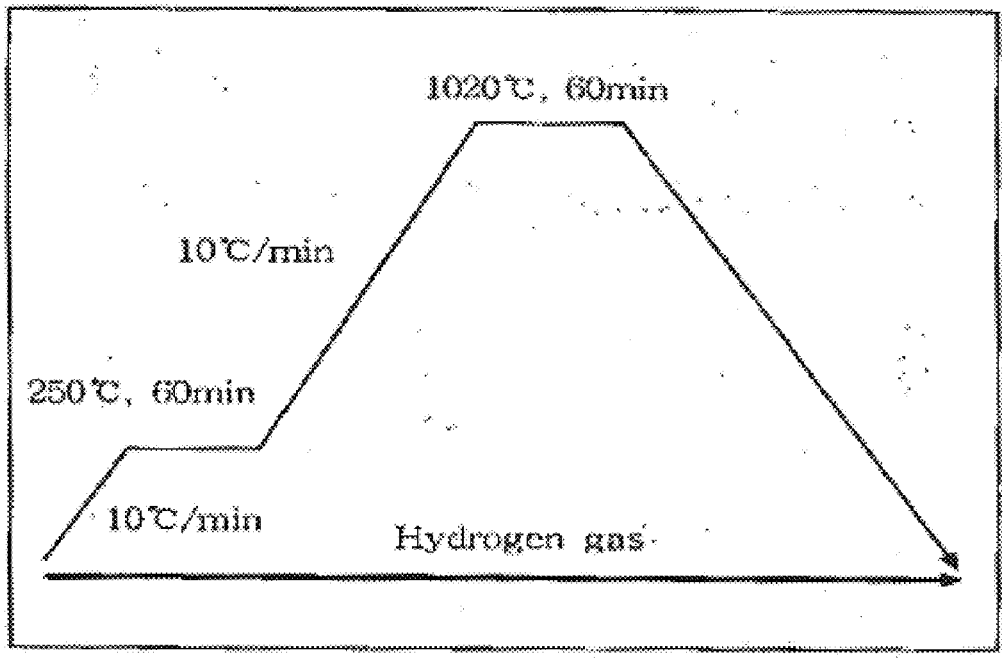
FIG. 2 illustrates a diagram of a thermal reduction treatment for coating a tungsten thin film on a metal substrate according to the present invention.
Figure 3:
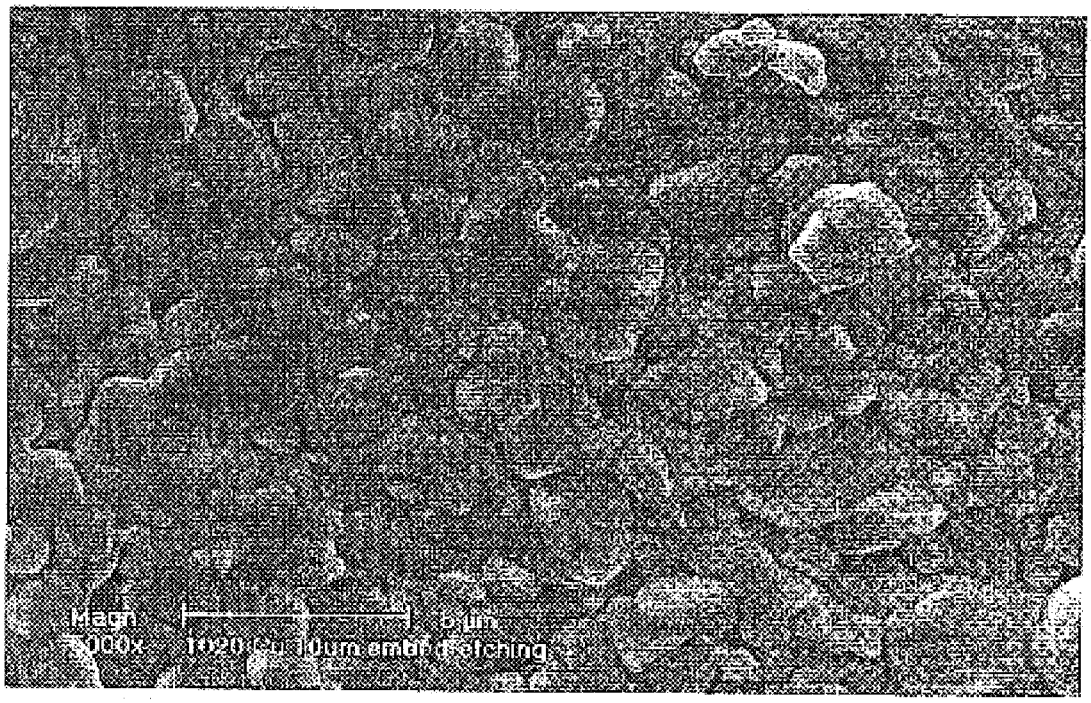
FIG. 3 illustrates a SEM picture of a tungsten thin film attained by thermal reduction treatment in accordance with the process shown in FIG. 2 after tungsten oxide powders are put on a copper substrate.
Figure 4:
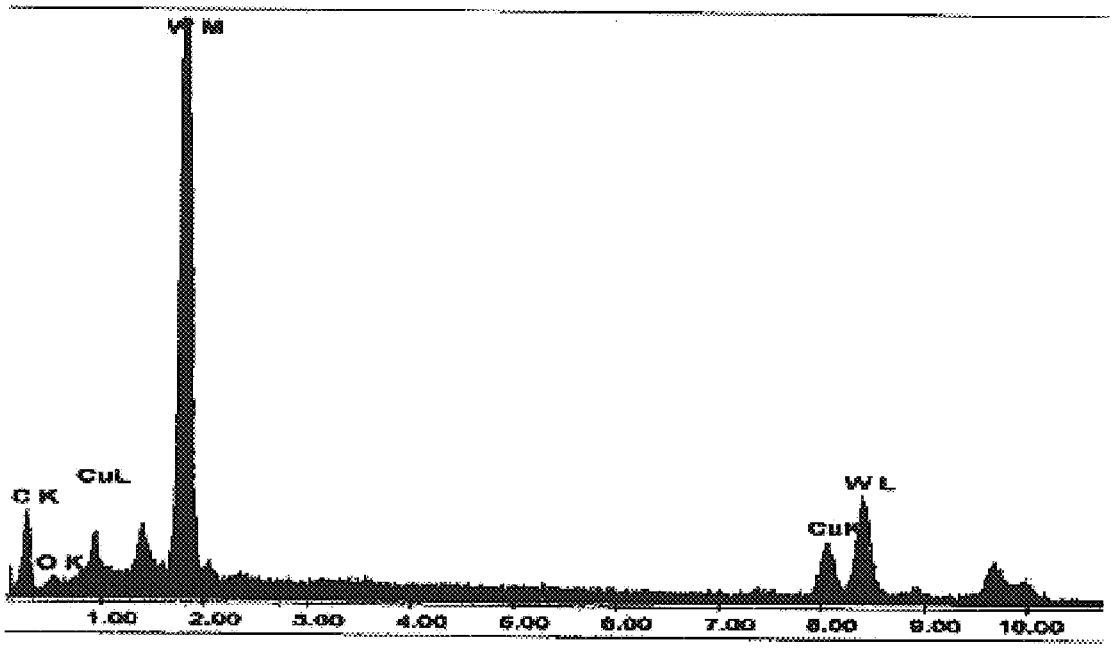
FIG. 4 illustrates an EDS (energy dispersive spectroscopy) profile of the thin film shown in FIG. 3.
Figure 5:
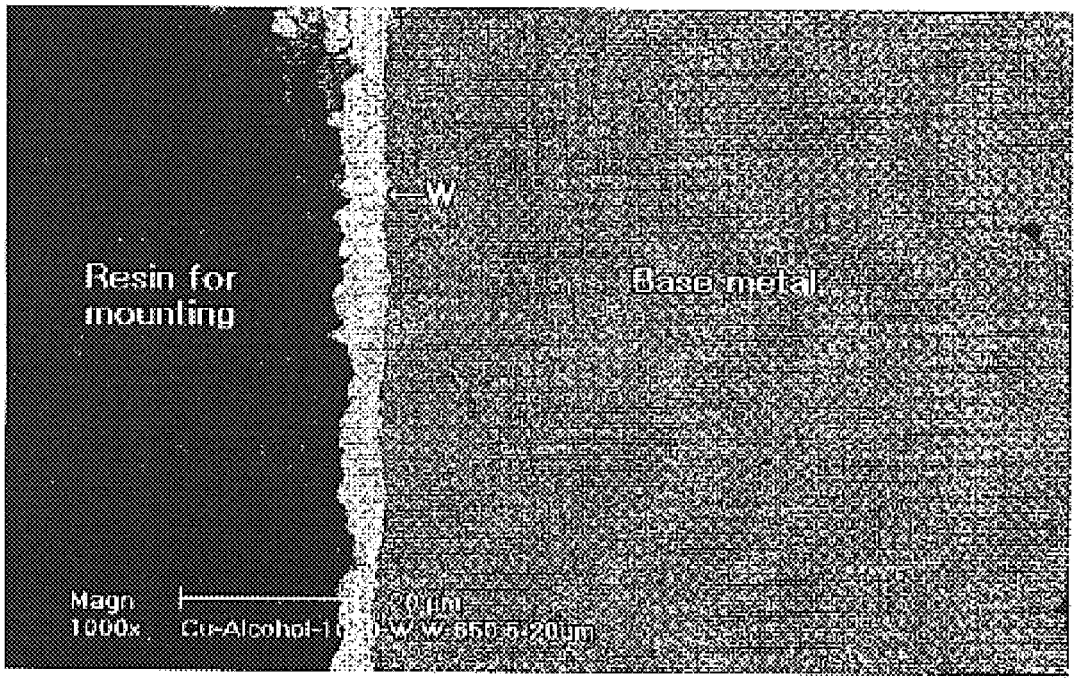
FIG. 5 illustrates a cross-sectional view of a thin film by SEM for representing a thickness of the tungsten thin film shown in FIG. 3.
Figure 6:
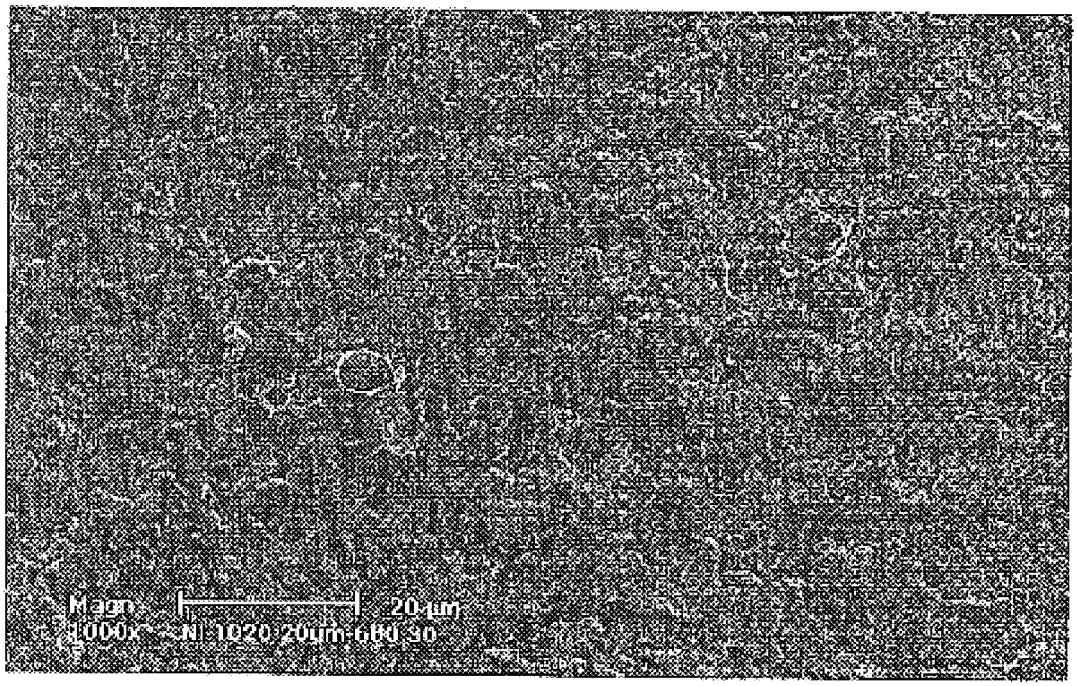
FIG. 6 illustrates a SEM picture of a tungsten thin film attained by thermal reduction treatment carried out for an hour at 1020° C. after tungsten oxide powders are put on a nickel substrate.
Figure 7:
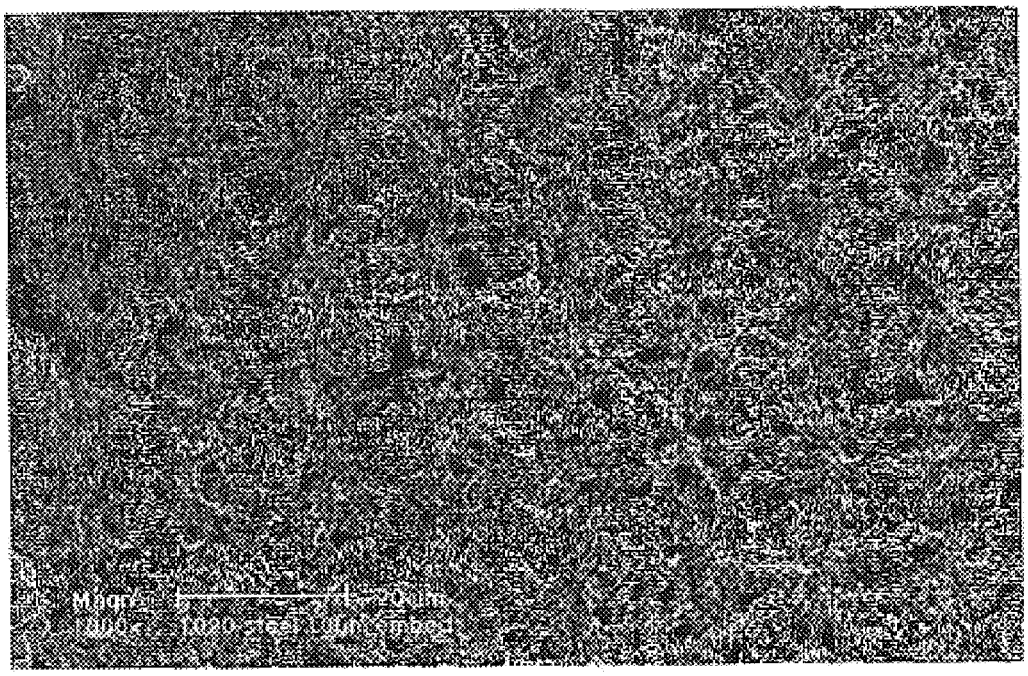
FIG. 7 illustrates a SEM picture of a tungsten thin film attained by thermal reduction treatment carried out for an hour at 1020° C. after tungsten oxide powders are put on a steel substrate.
Figure 8:
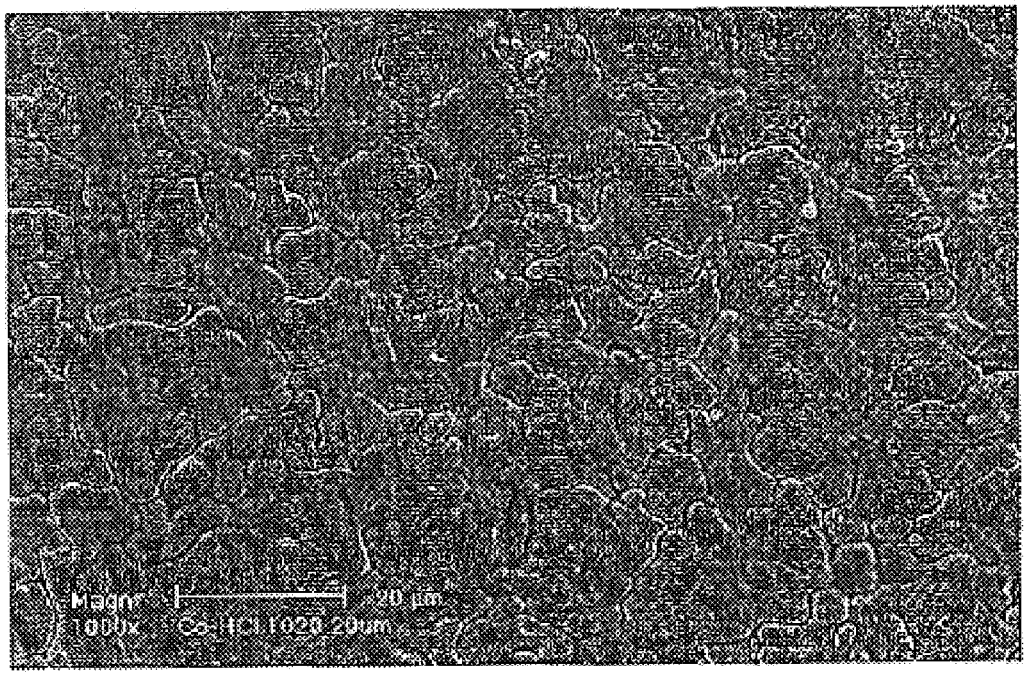
FIG. 8 illustrates a SEM picture of a tungsten thin film attained by thermal reduction treatment carried out for an hour at 1020° C. after tungsten oxide powders are put on a cobalt substrate.
Figure 9:
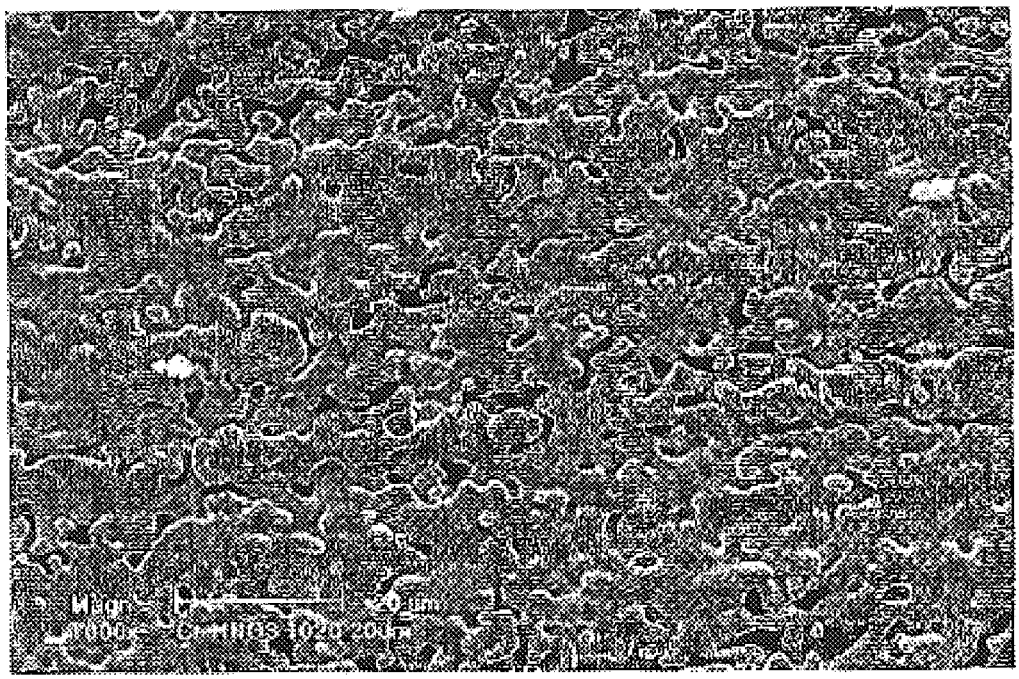
FIG. 9 illustrates a SEM picture of a tungsten thin film attained by thermal reduction treatment carried out for an hour at 1020° C. after tungsten oxide powders are put on a chrome substrate.
Figure 10:
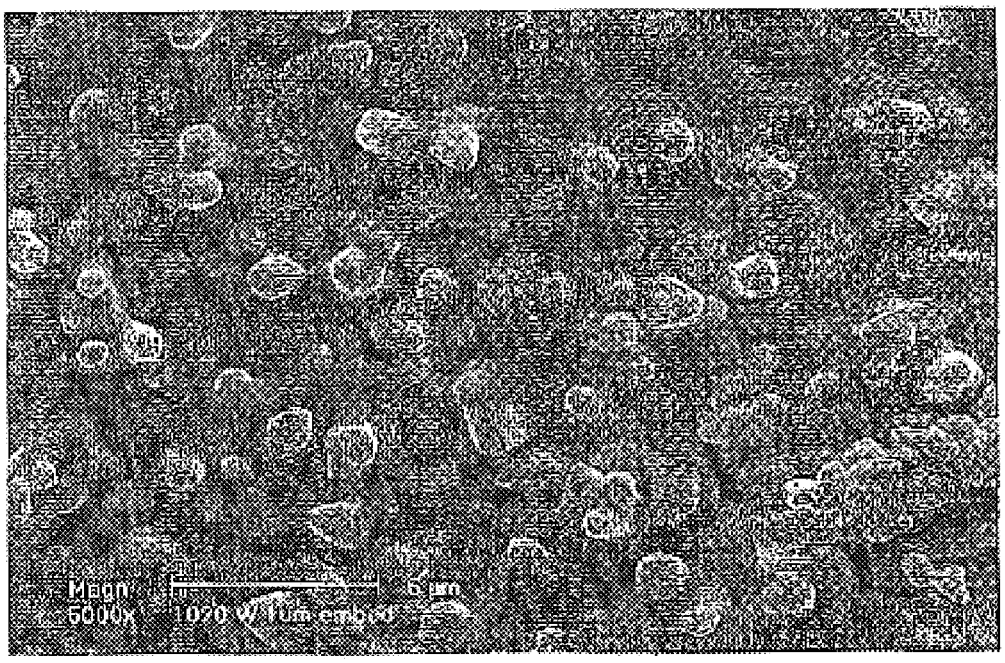
FIG. 10 illustrates a SEM picture of a tungsten thin film attained by thermal reduction treatment carried out for an hour at 1020° C. after tungsten oxide powders are put on a tungsten substrate.

Degreasing and pickling are carried out on a Cu substrate about 2 mm thick. After tungsten oxide ($WO_3$) powders of which mean grain size is about 5 $\mu$m have been coated on the Cu substrate to have a thickness of about 5 mm, as shown in FIG. 1, thermal treatment is carried out thereon under a dry hydrogen atmosphere having a dew point of (–) 60° C. in accordance with the process diagram shown in FIG. 2 so as to coat a tungsten thin film on the Cu substrate. FIG. 3 illustrates a SEM picture of a microstructure of a sample prepared by the above method, in which it can be seen that tungsten is coated on the Cu substrate uniformly. A chemical composition of the coating layer is identified as pure tungsten by an EDS (energy dispersive spectroscopy) analysis shown in FIG. 4. FIG. 5 is a SEM picture of a cross-section of the sample for indicating a thickness of the coating layer, in which it can be observed that a tungsten thin film is uniformly deposited several $\mu$m thick on the Cu substrate.

[Second Embodiment]

In order to investigate whether a tungsten thin film coating method using tungsten oxide powders according to the present invention is effective or not when another metal substrate is used instead of the Cu substrate, the same method of the first embodiment of the present invention is carried out but Ni, Fe, Co, Cr, and W are used for the metal substrate instead of Cu. FIGS. 6 to 10 illustrate SEM pictures of microstructures of samples prepared on Ni, Fe, Co, Cr, and W substrates, respectively. It can be seen that tungsten thin films are coated uniformly on the various substrates, respectively as is the tungsten coating layer on the Cu substrate in FIG. 3. Table 1 shows thickness variations of the tungsten thin films measured by changing the metal substrates in accordance with the above-method. As the metal substrates are changed, the thickness of the tungsten thin film varies from 3 $\mu$m to 20 $\mu$m.

TABLE 1

| Substrate metal | Cu | Ni | Fe | W |
|---|---|---|---|---|
| W film thickness($\mu$m) | 3~5 | 2~3 | 10~20 | 4~5 |

[Third Embodiment]

Figure 11:
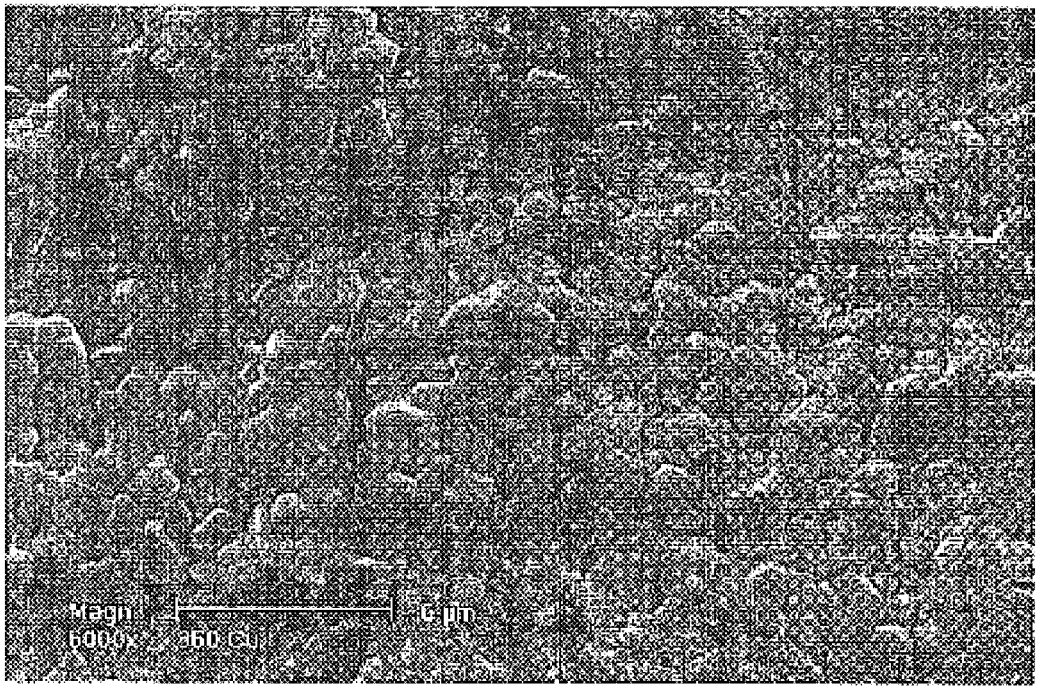
FIG. 11 illustrates a SEM picture of a tungsten thin film attained by thermal reduction treatment carried out for an hour at 850° C. after tungsten oxide powders are put on a copper substrate.
Figure 12:
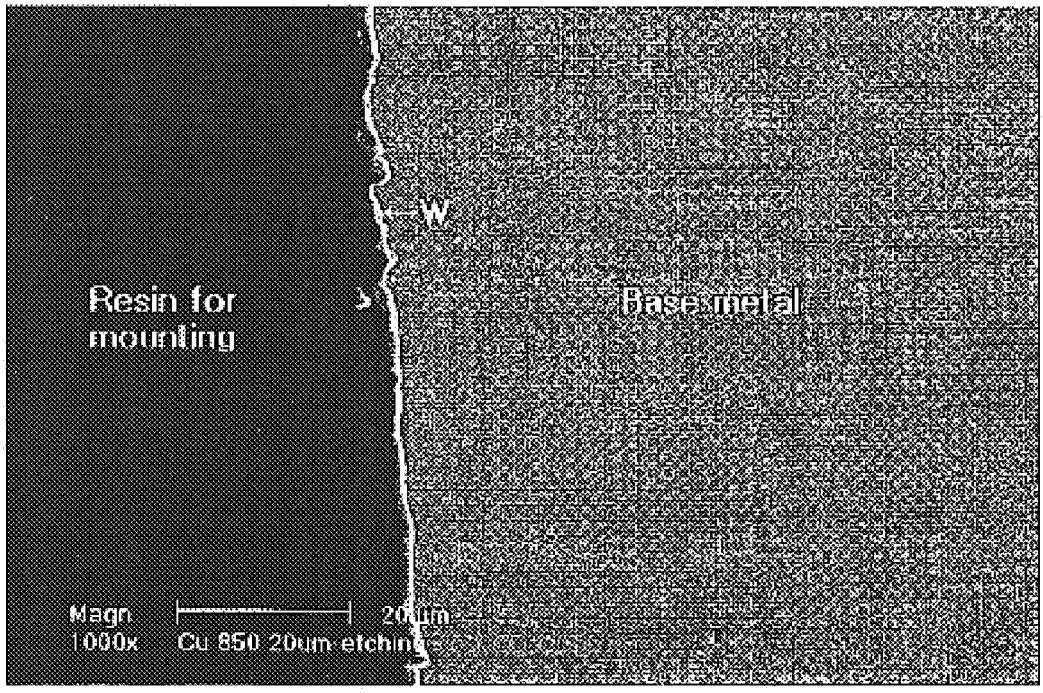
FIG. 12 illustrates a cross-sectional view of a thin film by SEM for representing a thickness of the tungsten thin film shown in FIG. 11.

In order to investigate the influence of the temperature of thermal reduction treatment on a thickness of a tungsten thin film coated on a metal substrate using tungsten oxide powders according to the present invention, the same method of the first embodiment is carried out but the reduction temperature of thermal treatment is set up as 650° C., 750° C., 850° C., and 950° C. for the tungsten coating test. FIG. 11 illustrates a SEM picture of a tungsten thin film attained by thermal reduction treatment carried out for an hour at 850° C. after tungsten oxide powders are put on a copper substrate. Compared to the tungsten thin film having a higher temperature of thermal reduction treatment in FIG. 3, the tungsten thin film shown in FIG. 11 has a decreased tungsten grain size. FIG. 12 illustrates a cross-sectional view of a thin film by SEM for representing a thickness of the tungsten thin film shown in FIG. 11. Compared to the thickness in FIG. 5, the thickness of the thin film is decreased. Table 2 shows thickness variation of a tungsten thin film in accordance with the temperature of the thermal reduction treatment. It can be seen that the tungsten coating technique using tungsten oxide powders according to the present invention is applicable to the thermal reduction treatment temperature range between 650° C. and 1050° C.

Moreover, as the thermal reduction treatment temperature increases, so does the thickness of the thin film.

TABLE 2

| | | Thermal treatment reduction temp. (° C.) | | | |
|---|---|---|---|---|---|
| | Substrate metal | 750 | 850 | 950 | 1020 |
| Thin film thickness (μm) | Cu | 0.5~1.0 | 1.0~2.0 | 2.0~3.0 | 3.0~5.0 |
| | Ni | 0.5~1.0 | 1.0~2.0 | 2.0~3.0 | 2.0~3.0 |

[Fourth Embodiment]

Figure 13:
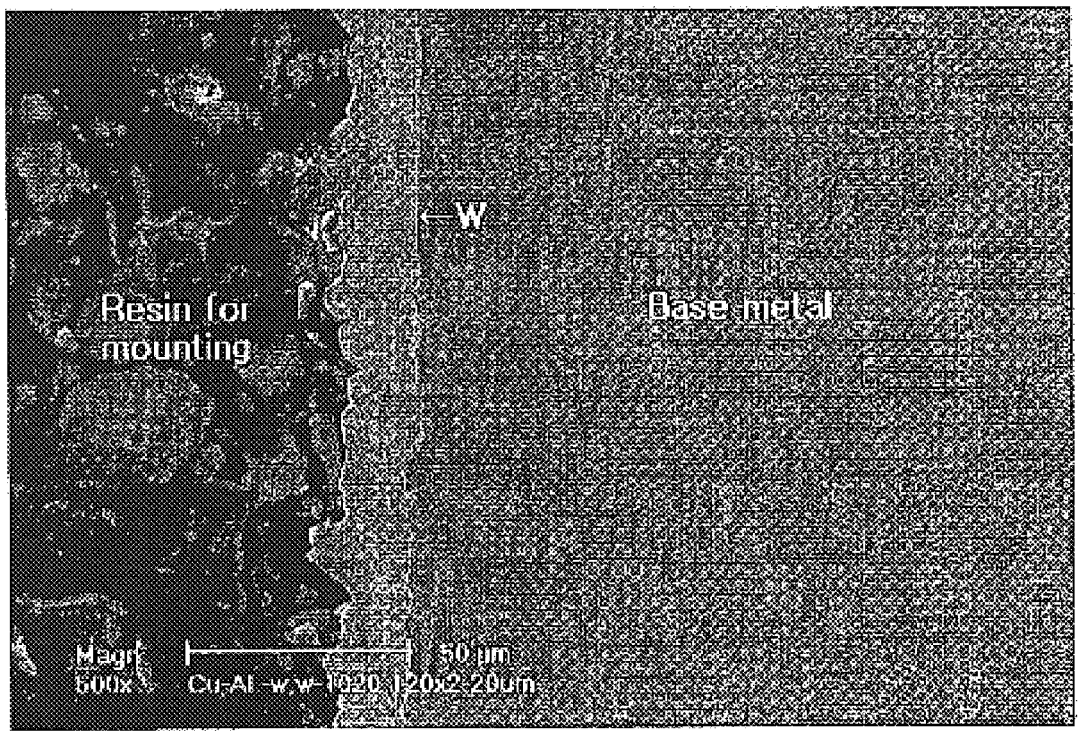
FIG. 13 illustrates a SEM picture of a tungsten thin film attained by thermal reduction treatment carried out for six hours at 1020° C. after tungsten oxide powders are put on a copper substrate.

In order to investigate the influence of a holding time at the given reduction temperature on thickness and property of a tungsten thin film using tungsten oxide according to the present invention, the same method of the first embodiment is carried out but a holding time is set up as 10 minutes, three hours, and six hours for the tungsten coating test. FIG. 13 illustrates a SEM picture of a tungsten thin film attained by thermal reduction treatment carried out for six hours at 1020° C. at a wet hydrogen atmosphere with the dew point of 10° C. after tungsten oxide powders are put on a steel substrate, in which it can be seen that the thickness of the tungsten thin film increases up to about 20 μm. Table 3 shows thickness variation of a tungsten thin film in accordance with a holding time at the thermal reduction treatment of 1020° C. Referring to Table 3, it can be seen that the thickness of the tungsten thin film depends on the holding time and humidity level of the used hydrogen.

TABLE 3

| Used gas | Dry hydrogen | | Wet hydrogen | | |
|---|---|---|---|---|---|
| Thermal treatment reduction time (min.) | 10 | 60 | 60 | 180 | 360 |
| W thin film thickness (μm) | 1~3 | 3~5 | 5~10 | 10~15 | 20~25 |

Accordingly, the present invention enables to provide a simple method of coating a tungsten thin film on a metal substrate using the phenomenon of tungsten migration through vapor phase when thermal reduction treatment is carried out on tungsten oxide powders without using previous chemical or physical vapor depositions requiring expensive precision equipments or causing environmental pollution.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A tungsten film coating method using tungsten oxide powders, comprising the steps of:

contacting the tungsten oxide powders with a metal substrate;

reducing the tungsten oxide powders into gaseous $WO_2(OH)_2$; and reducing the gaseous $WO_2(OH)_2$, into solid tungsten to be coated on the metal substrate.

2. The method of claim 1, wherein the metal substrate is selected from the group consisting of Cu, Fe, Ni, Co, Cr, and W substrates.

3. The method of claim 1 or claim 2, wherein the tungsten film is coated from 500 nm to about 25 μm thick by carrying out a thermal reduction treatment for 10 minutes to six hours at a temperature range between 650~1050° C.

* * * * *